US012543821B2

(12) United States Patent
Hartmann et al.

(10) Patent No.: US 12,543,821 B2
(45) Date of Patent: Feb. 10, 2026

(54) SOLE STRUCTURE OF A SHOE

(71) Applicants: PUMA SE, Herzogenaurach (DE); MASSACHUSETTS INSTITUTE OF TECHNOLOGY, Cambridge, MA (US)

(72) Inventors: Matthias Hartmann, Forchheim (DE); Reinhold Sussmann, Scheinfeld (DE); Federico Casalegno, San Francisco, CA (US); Hunmin Koh, Somerville, MA (US); Yihyun Lim, Somerville, MA (US); Yasaman Tahouni, Cambridge, MA (US); Will Walker, Oakland, CA (US)

(73) Assignees: PUMA SE, Herzogenaurach (DE); MASSACHUSETTS INSTITUTE OF TECHNOLOGY, Cambridge, MA (US)

( * ) Notice: Subject to any disclaimer, the term of this patent is extended or adjusted under 35 U.S.C. 154(b) by 0 days.

(21) Appl. No.: 18/228,780

(22) Filed: Aug. 1, 2023

(65) Prior Publication Data

US 2023/0371646 A1 Nov. 23, 2023

Related U.S. Application Data

(63) Continuation of application No. 17/053,510, filed as application No. PCT/EP2018/061934 on May 8, 2018, now Pat. No. 11,744,322.

(51) Int. Cl.
*A43B 13/18* (2006.01)
*A43B 13/12* (2006.01)

(52) U.S. Cl.
CPC ..... *A43B 13/181* (2013.01); *A43B 13/125* (2013.01); *A43B 13/187* (2013.01)

(58) Field of Classification Search
CPC ... A43B 13/181; A43B 13/125; A43B 13/187; A43B 13/206; A43B 13/14; A43B 1/0009; A43B 3/0052; A43B 3/0057
See application file for complete search history.

(56) References Cited

U.S. PATENT DOCUMENTS 2,983,056 A * 5/1961 Murawski ..... A43B 13/206 36/32 R
4,235,026 A * 11/1980 Plagenhoef ..... A43B 13/181 36/28

(Continued)

*Primary Examiner* — Haley A Smith
(74) *Attorney, Agent, or Firm* — Quarles & Brady LLP

(57) ABSTRACT

An article of footwear includes an upper and a sole structure. The sole structure has a longitudinal extension in a longitudinal direction and a vertical extension in a vertical direction and defines a plurality of recesses that extend into the sole structure at least in a transverse direction. The plurality of recesses includes a first row of recesses arranged toward the upper and a second row of recesses arranged vertically below the first row of recesses. Each recess of the plurality of recesses has, without external forces on the sole structure, a peripheral contour forming a shape of a lemniscate when viewed in the transverse direction and are larger in a first direction that in a second direction. The sole structure is configured such that, when an external force is applied to the sole structure, the plurality of recesses collapse in a predetermined manner.

18 Claims, 3 Drawing Sheets

(56) References Cited

U.S. PATENT DOCUMENTS

| | | | | | |
|---|---|---|---|---|---|
| 4,364,189 | A * | 12/1982 | Bates | A43B 13/12 | 36/31 |
| 4,506,461 | A * | 3/1985 | Inohara | A43B 13/20 | 36/35 B |
| 6,843,000 | B1 * | 1/2005 | Park | A43B 13/181 | 36/27 |
| 6,920,707 | B1 * | 7/2005 | Greene | A43B 13/16 | 36/97 |
| 2008/0127513 | A1 * | 6/2008 | Schinlder | A43B 13/206 | 36/25 R |
| 2014/0033574 | A1 * | 2/2014 | Wan | A43B 1/0072 | 36/103 |

* cited by examiner

SOLE STRUCTURE OF A SHOE

CROSS REFERENCE TO RELATED APPLICATIONS

The present application is a continuation of U.S. application Ser. No. 17/053,510, filed on Nov. 6, 2020, which is a U.S. National Stage application, filed pursuant to 35 U.S.C. § 371, of International Application No. PCT/EP2018/061934, filed on May 8, 2018, which are each incorporated herein by reference in their entirety.

REFERENCE REGARDING FEDERALLY SPONSORED RESEARCH OR DEVELOPMENT

Not applicable

SEQUENCE LISTING

Not applicable

BACKGROUND

The invention relates to a sole of a shoe, i.e., an article of footwear, particularly of an athletic shoe. The sole has an extension in a longitudinal direction and an extension in a vertical direction perpendicular thereto. A number of recesses is introduced into the sole that extend in a transverse direction perpendicular to the longitudinal direction and perpendicular to the vertical direction and permeate the sole at least in part.

In the case of sports shoes, an attempt is made to give the sole a certain and desired spring behaviour by means of the geometric design of the sole. This means that the sole exhibits a desired deformation behaviour in the vertical direction when subjected to the weight of the wearer of the shoe, in particular a certain characteristic curve between the force applied and the strain in the vertical direction.

A sole of the type mentioned above is known from U.S. Pat. No. 2,983,056. The body of the sole is provided here in transverse direction with a plurality of recesses, which are formed circularly, laterally on the sole, thus seen in transverse direction. The recesses have different diameters, whereby one with a smaller diameter is located between two recesses with a larger diameter. Such recesses can be used to influence the spring or damping behaviour of the sole.

The invention is based on the object to further develop a shoe sole of the type mentioned above in such a way that it becomes possible to influence the spring and damping behaviour of the sole in a desired, predetermined improved manner.

The solution of this object by the invention is characterized in that there is a first group of recesses, which (without external forces on the sole) are larger in the vertical direction than in the longitudinal direction, and a second group of recesses, which (without external forces on the sole) are smaller in the vertical direction than in the longitudinal direction. At least in sections, at least one row of recesses is arranged adjacent to each other in the longitudinal direction with a recess of the second group arranged between two recesses of the first group.

An upper row of recesses and a lower row of recesses can thereby be arranged above one another in the vertical direction, at least in sections. The upper and lower rows of recesses are in this case preferably arranged relative to each other in such a way that a recess of the first group lies vertically above a recess of the second group.

The recesses penetrate preferably at least partially the sole completely in the transverse direction.

The recesses extend thereby preferably along a straight line, and they are thus designed straight and linear respectively.

Without external forces on the sole, preferably the largest dimension of a recess in a first direction is thereby at least 150%, preferably at least 180%, of the largest dimension of the recess in a second direction perpendicular to the first direction. Thereby, it is specifically preferred that the recesses, seen in the transverse direction, have a peripheral contour which has the shape of an eight. The recess has in this case in a central region preferably a restriction with a minimum extension which is at most 90%, preferably at most 80%, of the largest dimension in the second direction.

The largest dimension is thereby preferably between 8 millimeters (mm) and 18 mm, specifically preferred between 10 mm and 15 mm.

The wall thickness of the material of the sole remaining between the recesses is preferably substantially constant at least in sections. Insofar, it is preferred that the wall thickness at least in sections is in a range between 80% and 120% of an average value of the wall thickness (the average value of the wall thickness is the arithmetic mean, which is determined for the respective wall thicknesses between adjacent recesses over a given defined area of the lateral surface of the sole).

The sole consists preferably of polyurethane material, thermoplastic polyurethane (TPU) or thermoplastic elastomer (TPE) or comprises at least this material. The material of the sole is thereby preferably foamed.

The material of the sole has preferably a density between 0.20 and 0.50 g/cm$^3$. The sole has preferably a hardness between 30 and 50 Asker C.

The sole can be designed as a midsole. Thereby, it is possible that an outer sole is arranged below the midsole.

The recesses are preferably arranged in the longitudinal direction over at least 33% of the total longitudinal extension of the sole. The recesses are preferably arranged at least in a midfoot region and a rearfoot region of the sole.

The proposed design of the sole makes it possible to influence the control of the spring and cushioning properties or the hardness of the sole in a simple way. By the design of the recesses it is possible to realize a desired spring deflection when the sole is loaded with the weight of the wearer of the shoe equipped with the sole.

The present invention is based on the use of so-called "Mechanical Meta Material", in which it is intended that various rows of openings (known in the art are mainly round or oval shaped recesses in cross-section) of different sizes are or are to be introduced into the sole in order to achieve a certain spring or cushioning behaviour of the sole. This enables "Engineered Damping", in which the spring or damping properties obey a desired characteristic curve.

When a deformation force—caused by the weight of the wearer of the shoe—is applied, the resulting cells collapse in a special way so that special spring or damping characteristics can be realized.

In this respect, a "programmable folding or collapsing" of the sole structure is achieved, so to speak, since the structure itself forms a coherent system and the individual material sections are interdependent.

The advantages of the proposed structure can lead to a "negative stiffness", i.e., if the sole is slightly compressed in a vertical direction, the sole collapses in a defined way. It is also possible to structure the sole in the way described above in such a way that it has a sufficient degree of elasticity on the one hand and absorbs deformation energy as a result of a deformation force on the other.

SUMMARY

A shoe, i.e., an article of footwear, as described herein, may have various configurations. For example, an article of footwear may have an upper and a sole structure connected to the upper.

In some aspects, the present disclosure provides an article of footwear including an upper and a sole structure having a longitudinal extension in a longitudinal direction and a vertical extension in a vertical direction that is perpendicular to the longitudinal direction. The sole structure defines a plurality of recesses that extend into the sole structure at least in a transverse direction. The plurality of recesses is arranged at least in a rearfoot region of the sole structure and includes a first row of recesses arranged toward the upper and a second row of recesses arranged vertically below the first row of recesses. Without external forces on the sole structure, each recess of the plurality of recesses has a peripheral contour forming a shape of a lemniscate when viewed in the transverse direction and are larger in a first direction than in a second direction. The sole structure is configured such that, when an external force is applied to the sole structure, the plurality of recesses collapse, at least in sections, in a predetermined manner.

In some embodiments, the first direction is disposed at an angle with respect to the longitudinal direction. In some embodiments, the second direction is disposed at an angle with respect to the vertical direction. In some embodiments, the first direction is perpendicular with respect to the second direction. In some embodiments, the plurality of recesses is arranged at least in a midfoot region and the rearfoot region of the sole structure. In some embodiments, a wall thickness of a material of the sole structure remaining between adjacent recesses of the plurality of recesses, as measured along the longitudinal direction, is in a range of 80% to 120%, inclusive, of a mean wall thickness in at least the rearfoot region of the sole structure. In some embodiments, the sole structure if formed of a polyurethane material. In some embodiments, the plurality of recesses is arranged in the longitudinal direction over at least 33% of a total distance taken along the longitudinal extension of the sole structure. In some embodiments, the plurality of recesses is defined on a midsole of the sole structure that is connected to the upper and an outsole of the sole structure is arranged below the midsole.

In some aspects, the present disclosure provides an article of footwear including an upper and a sole structure having a longitudinal extension in a longitudinal direction and a vertical extension in a vertical direction that is perpendicular to the longitudinal direction. The sole structure includes a midsole connected to the upper and an outsole connected to the midsole. The midsole defines a plurality of recesses that extend into the midsole at least in a transverse direction that is substantially perpendicular to the longitudinal direction. The plurality of recesses is arranged at least in a rearfoot region and a midfoot region of the midsole, and includes a first row of recesses arranged toward the upper and a second row of recesses arranged vertically between the first row of recesses and the outsole. A wall thickness of a material of the midsole remaining between adjacent recesses of the plurality of recesses, as measured along the longitudinal direction, is in a range of 80% to 120%, inclusive, of a mean wall thickness in at least the rearfoot region of the midsole. Without external forces on the sole structure, each recess of the plurality of recesses has a peripheral contour forming a shape of a lemniscate when viewed in the transverse direction and are larger in a first direction than in a second direction. The midsole is configured such that, when an external force is applied to the sole structure, the plurality of recesses collapse, at least in sections, in a predetermined manner to provide a spring characteristic of the sole structure.

In some embodiments, the midsole is formed of a polyurethane material. In some embodiments, the midsole has elastomeric properties. In some embodiments, without external forces on the sole structure, each recess of the plurality of recesses has a largest first dimension in the first direction, a largest second dimension in the second direction, and a restriction in a central region that has a minimum dimension which is at most 90% of the largest second dimension. In some embodiments, the wall thickness of the material of the midsole remaining between adjacent recesses of the plurality of recesses, as measured along the longitudinal direction, is constant in at least the rearfoot region of the midsole.

In some aspects, the present disclosure provides an article of footwear including an upper and a sole structure having a longitudinal extension in a longitudinal direction and a vertical extension in a vertical direction that is perpendicular to the longitudinal direction. The sole structure defines a plurality of recesses that extend into the sole structure in a transverse direction that is substantially perpendicular to the longitudinal direction and to the vertical direction. The plurality of recesses is arranged at least in a rearfoot region and a midfoot region of the sole structure. The plurality of recesses includes a first row of recesses arranged toward the upper and a second row of recesses arranged vertically below the first row of recesses. The first row of recesses is arranged adjacent to the second row of recesses in the longitudinal direction such that a recess of the second row of recesses is arranged between two recesses of the first row of recesses. Without external forces on the sole structure, each recess of the plurality of recesses is larger in a first direction than in a second direction that is perpendicular to the first direction. The sole structure is configured such that, when an external force is applied to the sole structure, the plurality of recesses collapse, at least in sections, in a predetermined manner.

In some embodiments, at least some of the recesses of the plurality of recesses disposed in the rearfoot region of the sole structure penetrate the sole structure completely in the transverse direction over an entire width of the sole structure. In some embodiments, the second direction is substantially aligned with the vertical direction. In some embodiments, without external forces on the sole structure, each recess of the plurality of recesses has a peripheral contour forming a non-circular shape when viewed in the transverse direction. In some embodiments, a largest first dimension of a recess of the plurality of recesses in the first direction is at least 150% of a largest second dimension of the recess in the second direction. In some embodiments, the sole structure is formed of a material that is foamed. In some embodiments, the sole structure is formed of a material having a density of between 0.20 g/cm$^3$ and 0.50 g/cm$^3$, inclusive.

BRIEF DESCRIPTION OF THE DRAWINGS

In the drawings an embodiment of the invention is shown.

DETAILED DESCRIPTION OF THE DRAWINGS

Figure 1:
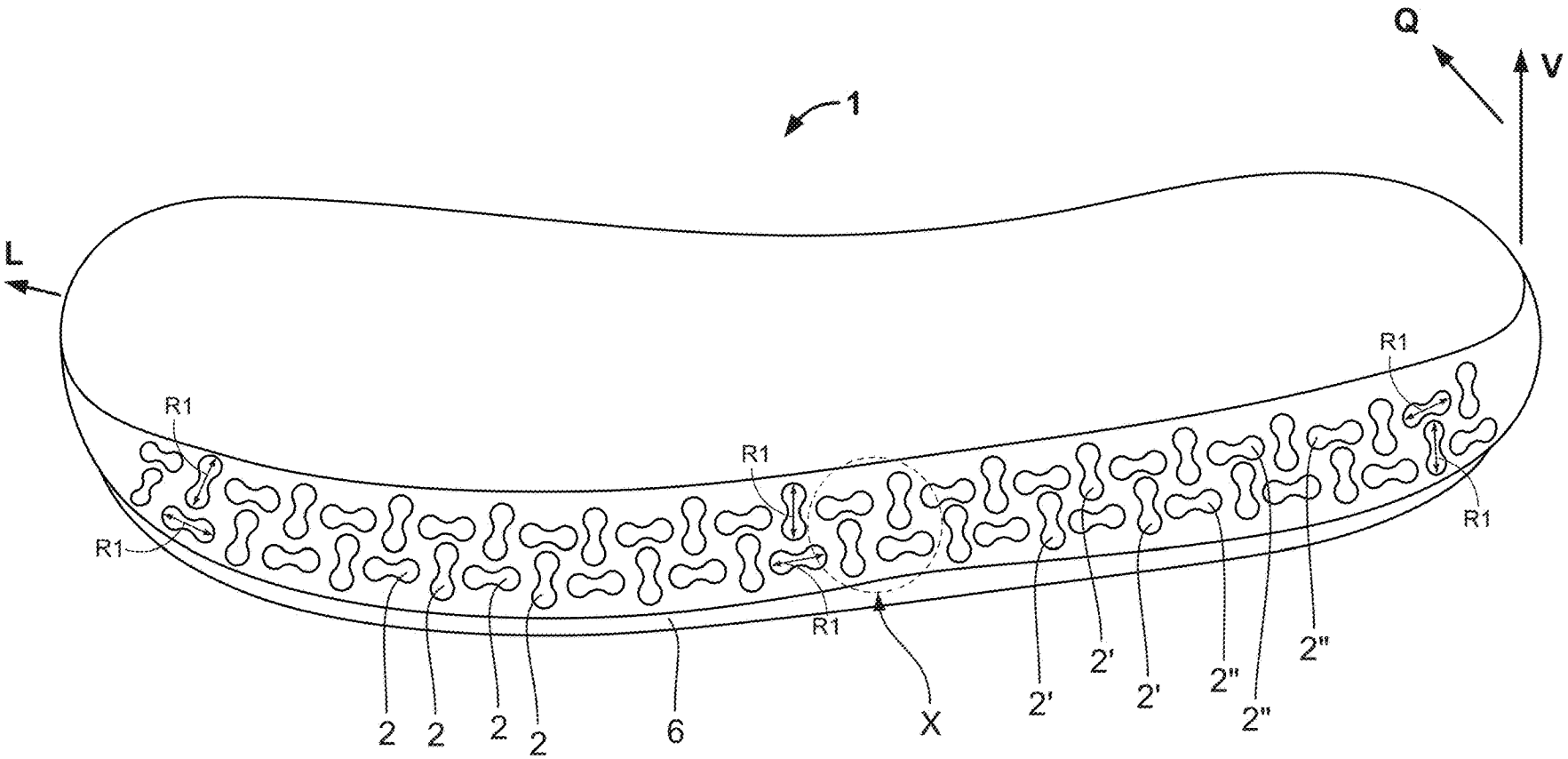
FIG. 1 is a side perspective view of a sole of a shoe.

FIG. 1 shows a sole 1, which extends in a longitudinal direction (L) (corresponding to the longitudinal axis of the shoe with the sole) and in a vertical direction (V) (the vertical direction (V) indicates the direction when the shoe or the sole is standing on the ground when used as intended). Furthermore, sole 1 extends in a transverse direction (Q), which is perpendicular to both the longitudinal direction (L) and the vertical direction (V).

Sole 1 is here designed as a midsole, to the upper side of which the shoe upper (not shown) is attached in the known manner. An outer sole 6 is attached to the bottom of the sole.

Recesses 2 are incorporated into the sole 1. Preferably, these recesses extend in transverse direction (Q) over an entire width of the sole 1. Details of the design and arrangement of recesses 2 are shown in FIGS. 2 and 3, with FIG. 2 showing the detailed area labeled "X" in FIG. 1 and FIG. 3 showing the geometrical design of a preferred design of a single recess 2.

Figure 2:
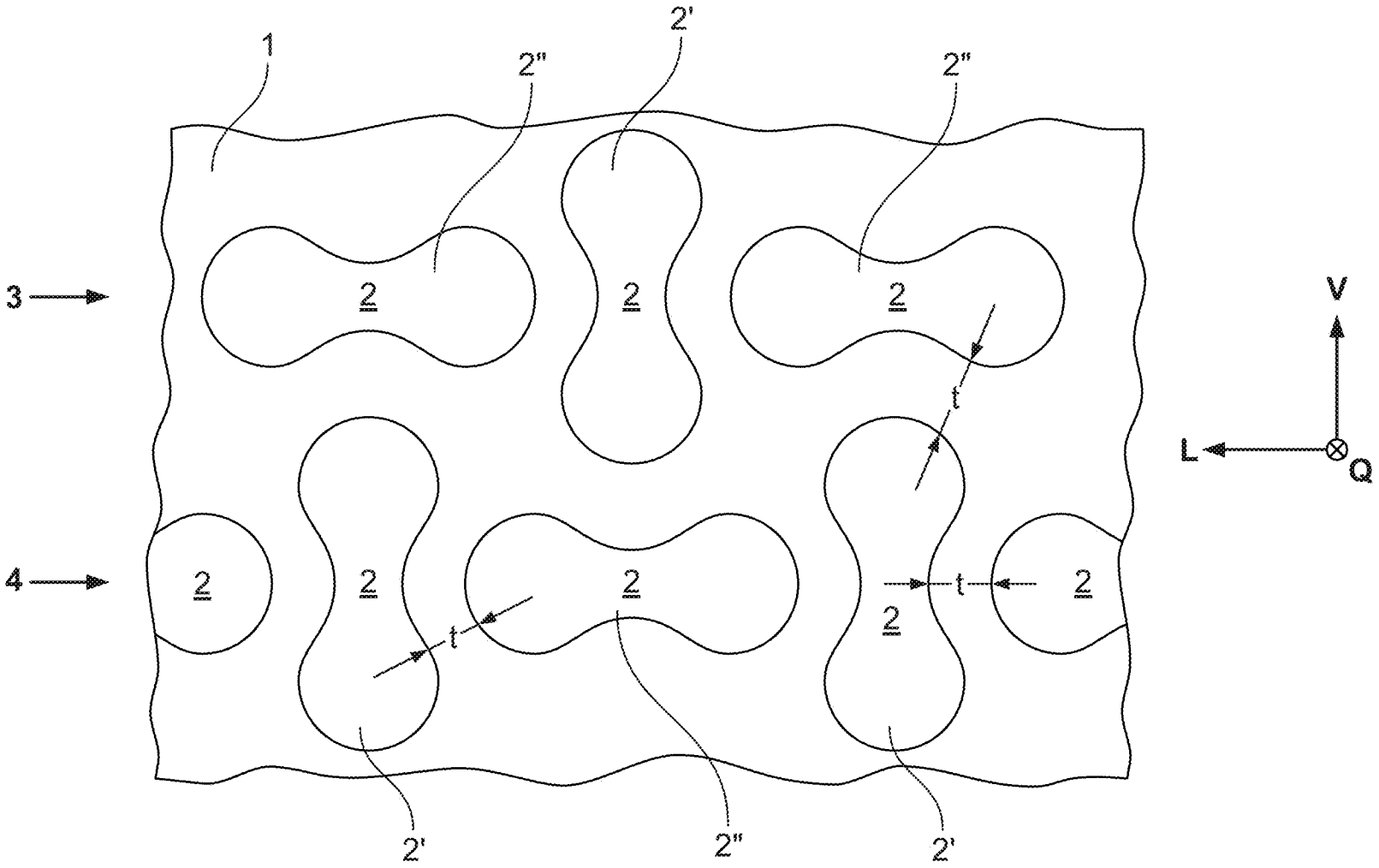
FIG. 2 is a detail view of the area labeled "X" of FIG. 1, seen in a transverse direction of the sole.

As can be seen in FIG. 2 in combination with FIG. 1, two rows 3, 4 of recesses 2 are incorporated into the sole 1. Thereby, two groups of recesses 2 are employed. A first group of recesses 2' is designed in such a way that—without external forces on the sole 1—the recesses 2' are larger in vertical direction (V) than in longitudinal direction (L). Then there is a second group of recesses 2", which—again without external forces on the sole 1—are smaller in vertical direction (V) than in longitudinal direction (L). As shown in FIG. 2, in each row 3, 4 along longitudinal direction (L) the recesses 2', 2" are arranged next to each other in such a way that a recess of the second group 2" is arranged between two recesses of the first group 2'.

Figure 3:
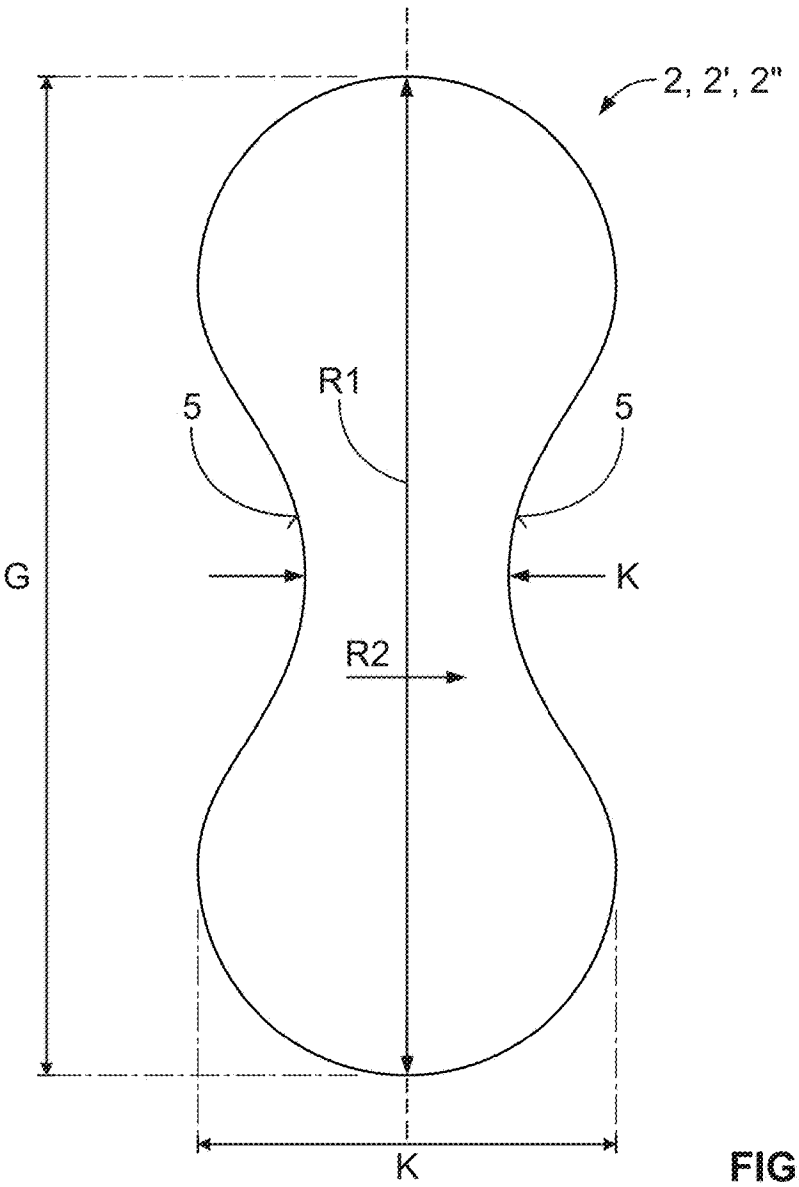
FIG. 3 is a detail view of a recess of the sole of FIG. 1.

With particular reference to FIG. 3, the individual recesses of the first and second groups of recesses 2', 2" are each designed in such a way that they have the shape of an "eight" when viewed in transverse direction (Q).

Accordingly, each recess 2, 2', 2" has in a first direction (R1) a largest dimension (G) (which is preferably between 10 mm and 15 mm) and has in a second direction (R2), which is perpendicular to the first direction (R1), a largest dimension (K). Specifically, the largest dimension (G) is a singular largest dimension of the recesses 2, 2', 2", which exceeds all other dimensions of the recesses 2, 2', 2". For example, when the sole 1 is viewed in the transverse direction, any dimension of the recesses 2, 2', 2" measured perpendicular to the transverse direction and parallel to or at an angle relative to the first direction (R1) is smaller than the largest dimension (G). Additionally, a dimension (G) is preferably at least 150% (particularly preferably even at least 180%) of the dimension (K). Referring briefly to FIG. 1, one or more of the recesses 2, 2', 2" are oriented obliquely relative to the vertical direction (V) and the longitudinal direction (L). Specifically, an R1 axis extending along the first direction (R1) (e.g., extending through largest dimension (G) of one or more of the recesses 2, 2', 2", as shown in FIG. 3) is oriented obliquely relative to the vertical direction (V) and the longitudinal direction (L). A plurality of the recesses 2, 2', 2" define an R1 axis that is oriented obliquely relative to the vertical direction (V). Further, the R1 axis of one or more the recesses 2, 2', 2" is parallel with respect to the longitudinal direction (L), and the R1 axis of one or more of the recesses 2, 2', 2" is parallel with respect to the vertical direction (V). Accordingly, one or more of the recesses 2, 2', 2" are oriented obliquely relative to one another. Specifically, the R1 axis of one or more of the recesses 2, 2', 2" is oriented obliquely relative to the R1 axis extending through another of the one or more of the recesses 2, 2', 2". A plurality of the recesses 2, 2', 2" define a plurality of the R1 axes that are oriented obliquely relative to the R1 axes of another plurality of the recesses 2, 2', 2". In the central area along the extension in the first direction (R1), the recesses 2', 2" have a restriction 5 (which results in the shape of an "eight"), so that the recesses 2', 2" have a minimal extension (k) here. This minimum extension (k) is preferably at most 90%, especially preferably at most 80%, of the dimension (K).

A remaining wall thickness (t), which results between adjacent recesses 2', 2", is denoted in FIG. 2 at various points. If one determines an (arithmetic) mean value between the respective wall thicknesses (t) over a selected area (such as the area shown in FIG. 2), it is preferably intended that the wall thickness (t) remains essentially constant. Specifically, this can be quantified to the effect that the wall thickness (t) at any point of the selected area is not less than 80% and not more than 120% of the mean wall thickness (t).

Through the proposed design, it can be achieved that the sole of the shoe has a special spring or cushioning behaviour, whereby, in particular when subjected to the weight of the wearer of the shoe, a predetermined collapse of the sole occurs as a result of the recesses, which provides a pleasant feeling of wear.

List of reference numerals: sole 1; recess 2; recess of the first group 2'; recess of the second group 2"; row of recesses 3; row of recesses 4; restriction 5; outer sole 6; longitudinal direction (L); vertical direction (V); transverse direction (Q); first direction (R1); second direction (R2); largest dimension of the recess in the first direction (G); largest dimension of the recess in the second direction (K); smallest extension (k); and wall thickness (t).

We claim:

1. An article of footwear, comprising:

an upper; and a sole structure having a longitudinal extension in a longitudinal direction and a vertical extension in a vertical direction that is perpendicular to the longitudinal direction and perpendicular to a ground plane when the sole structure is standing on a ground surface, the sole structure defining a plurality of recesses that extend into the sole structure at least in a transverse direction, wherein the plurality of recesses is arranged at least in a rearfoot region of the sole structure and includes a first row of recesses arranged toward the upper and a second row of recesses arranged vertically below the first row of recesses, wherein, without external forces on the sole structure, each recess of the plurality of recesses has a peripheral contour forming a shape of a lemniscate when viewed in the transverse direction and are larger in a first direction than in a second direction, wherein the sole structure is configured such that, when an external force is applied to the sole structure, the plurality of recesses collapse, at least in sections, in a predetermined manner, wherein a first recess of the plurality of recesses includes a singular largest dimension, and wherein a first axis extends in the first direction parallel to the singular largest dimension, wherein the first axis is disposed obliquely relative to the vertical direction.

2. The article of footwear of claim 1, wherein the plurality of recesses is arranged at least in a midfoot region and the rearfoot region of the sole structure.

3. The article of footwear of claim 1, wherein a wall thickness of a material of the sole structure remaining between adjacent recesses of the plurality of recesses, as measured along the longitudinal direction, is in a range of 80% to 120%, inclusive, of a mean wall thickness between adjacent recesses of the plurality of recesses, as measured along the longitudinal direction, in at least the rearfoot region of the sole structure.

4. The article of footwear of claim 1, wherein the sole structure comprises a polyurethane material.

5. The article of footwear of claim 1, wherein the plurality of recesses is arranged in the longitudinal direction over at least 33% of a total distance taken along the longitudinal extension of the sole structure.

6. The article of footwear of claim 1, wherein the plurality of recesses is defined on a midsole of the sole structure, and wherein the midsole is connected to the upper and an outsole of the sole structure is arranged below the midsole.

7. An article of footwear, comprising:

an upper; and a sole structure having a longitudinal extension in a longitudinal direction and a vertical extension in a vertical direction that is perpendicular to the longitudinal direction and perpendicular to a ground plane when the sole structure is standing on a ground surface, the sole structure comprising:

a midsole connected to the upper, the midsole defining a plurality of recesses that extend into the midsole at least in a transverse direction that is substantially perpendicular to the longitudinal direction; and an outsole connected to the midsole, wherein the plurality of recesses is arranged at least in a rearfoot region and a midfoot region of the midsole, wherein the plurality of recesses includes a first row of recesses arranged toward the upper and a second row of recesses arranged vertically between the first row of recesses and the outsole, wherein, without external forces on the sole structure, each recess of the plurality of recesses has a peripheral contour forming a shape that, when viewed in the transverse direction, is larger in a first direction than in a second direction and has a restriction in a central region that has a minimum dimension which is at most 90% of a largest dimension in the second direction;

wherein the midsole is configured such that, when an external force is applied to the sole structure, the plurality of recesses collapse, at least in sections, in a predetermined manner to provide a spring characteristic of the sole structure, wherein a first recess of the first row of recesses includes a first singular largest dimension, and wherein a first axis extends parallel to the first singular largest dimension, wherein a second recess of the first row of recesses includes a second singular largest dimension, and wherein a second axis extends parallel to the second singular largest dimension, and wherein the first axis is disposed obliquely relative to the second axis.

8. The article of footwear of claim 7, wherein the midsole comprises a polyurethane material.

9. The article of footwear of claim 8, wherein the midsole has elastomeric properties.

10. The article of footwear of claim 7, wherein, without external forces on the sole structure, each recess of the plurality of recesses has a largest first dimension in the first direction and a largest second dimension in the second direction.

11. The article of footwear of claim 7, wherein the wall thickness of the material of the midsole remaining between adjacent recesses of the plurality of recesses, as measured along the longitudinal direction, is constant in at least the rearfoot region of the midsole.

12. An article of footwear, comprising:

an upper; and a sole structure having a longitudinal extension in a longitudinal direction and a vertical extension in a vertical direction that is perpendicular to the longitudinal direction and perpendicular to a ground plane when the sole structure is standing on a ground surface, the sole structure defining a plurality of recesses that extend into the sole structure in a transverse direction that is substantially perpendicular to the longitudinal direction and to the vertical direction, wherein the plurality of recesses is arranged at least in a forefoot region and a midfoot region of the sole structure, wherein the plurality of recesses includes a first row of recesses arranged toward the upper and a second row of recesses arranged vertically between the first row of recesses and the outsole, the first row of recesses being arranged adjacent to the second row of recesses in the longitudinal direction such that a recess of the second row of recesses is arranged between two recesses of the first row of recesses, wherein, without external forces on the sole structure, each recess of the plurality of recesses is larger in a first direction than in a second direction that is perpendicular to the first direction, and wherein the sole structure is configured such that, when an external force is applied to the sole structure, the plurality of recesses collapse, at least in sections, in a predetermined manner, wherein a first recess of the first row of recesses includes a first axis extending in the first direction parallel to and through a singular largest dimension of the recess, the first axis being disposed obliquely relative to the longitudinal direction, wherein a second recess of the first row of recesses includes a second singular largest dimension, and wherein a second axis extends parallel to the second singular largest dimension, and wherein the first axis is disposed obliquely relative to the second axis.

13. The article of footwear of claim 12, wherein at least some of the recesses of the plurality of recesses are disposed in the rearfoot region of the sole structure and penetrate the sole structure completely in the transverse direction over an entire width of the sole structure.

14. The article of footwear of claim 12, wherein the second direction is substantially aligned with the vertical direction.

15. The article of footwear of claim 12, wherein, without external forces on the sole structure, each recess of the plurality of recesses has a peripheral contour forming a non-circular shape when viewed in the transverse direction.

16. The article of footwear of claim 12, wherein a largest first dimension of a recess of the plurality of recesses in the first direction is at least 150% of a largest second dimension of the recess in the second direction.

17. The article of footwear of claim 12, wherein the sole structure comprises a material that is foamed.

18. The article of footwear of claim 12, wherein the sole structure comprises a material having a density of between 0.20 $g/cm^3$ and 0.50 $g/cm^3$, inclusive.

* * * * *